US005979657A

United States Patent [19]

Bumbera

[11] Patent Number: 5,979,657

[45] Date of Patent: Nov. 9, 1999

[54] COMBINATION STIRRER AND CONDIMENT DISPENSER

[76] Inventor: Steve Bumbera, 1634 Bennett Ave., St. Charles, Mo. 63301

[21] Appl. No.: 08/800,102

[22] Filed: Feb. 13, 1997

[51] Int. Cl.[6] ..... B65D 77/08

[52] U.S. Cl. ..... 206/568; 206/219; 426/115

[58] Field of Search ..... 206/216, 219, 206/568, 459.5, 526; 426/112, 115, 120

[56] References Cited

U.S. PATENT DOCUMENTS

| | | | |
|---|---|---|---|
| 3,721,528 | 3/1973 | Mead et al. | 206/216 |
| 4,387,809 | 6/1983 | Botzler | 206/216 |
| 5,125,534 | 6/1992 | Rose et al. | 426/115 |
| 5,223,245 | 6/1993 | Ibrahim et al. | 206/568 |
| 5,325,273 | 6/1994 | Kuo | 206/219 |
| 5,529,179 | 6/1996 | Hanson | 206/217 |
| 5,664,670 | 9/1997 | Cozzie | 426/115 |

*Primary Examiner*—Paul T. Sewell
*Assistant Examiner*—Luan K. Bui
*Attorney, Agent, or Firm*—Henry W. Cummings

[57] ABSTRACT

In accordance with the present invention, a combination stirrer and condiment dispenser includes a body portion having at least a pair of laterally spaced compartments for holding at least a pair of substances to be dispensed into a drinking glass or drinking cup. The end portions of the compartments are capped to hold the substances to be dispensed in place. In one embodiment the caps are located at opposite ends of the stirrer body portion so that the substances to be dispensed may be separately dispensed into the cup or glass. In another embodiment the caps are located at the same end of the stirrer body portion so that both substances may be simultaneously dispensed into the cup or glass. After one or both substances are dispensed into the cup or glass the body portion may be used to stir the dispensed item into the liquid in a mixing operation.

10 Claims, 4 Drawing Sheets

EASY DISPENSTIR
CREAMER
SUGAR
YOUR COMPANY LOGO HERE
3A
3A
24'
26'
10'
12'
14'
16'
17'
19'
42'
40'
43'
PULL
PULL

14'
18'
16'
12'

PULL
PULL

TEAR HERE TO DISPENSE
PULL
PULL

PULL
PULL

PULL
PULL

DIE CUT SLOTS

70'

73'

50'
PULL
PULL

EASY DISPENSTIR
YOUR COMPANY LOGO HERE
CREAMER
SUGAR

45'
19'
23'
17'
20'
40'
27'

COMBINATION STIRRER AND CONDIMENT DISPENSER

I FIELD OF THE INVENTION

This invention relates to a combination stirrer and condiment dispenser to dispense items into a liquid drink and then stir the items dispensed into the liquid.

II BACKGROUND OF THE INVENTION

U.S. Pat. Nos. 309,905; 3,485,416 and 4,387,809 disclose condiment dispensers in which more than one substance may be dispensed and in which the compartments for holding the substances within the body of the dispenser are longitudinally spaced apart.

U.S. Pat. No. 1,254,115 discloses a combination drinking straw and container which could be used to dispense an item from inside the container.

U.S. Pat. Nos. 3,034,905 and 2,901,357 disclose methods of manufacturing tubes or straws in which materials may be located within the straws and then may be dispensed from the straw.

III SUMMARY OF THE INVENTION (A) Objects of the Invention

One object of the present invention is to provide a combination stirrer and condiment dispenser in which more than one substance may be dispensed from the combination stirrer and condiment dispenser.

Another object of the present invention is to provide a combination stirrer and condiment dispenser which is sufficiently inexpensive that it can be discarded after use.

Another object of the present invention is to provide a combination stirrer and condiment dispenser which dispenses more than one substance and in which the compartments containing the substances are laterally spaced apart so that both substances can be dispensed from the same end of the combination stirrer and condiment dispenser.

(B) Summary

In accordance with the present invention, a combination stirrer and condiment dispenser includes a body portion having at least a pair of laterally spaced compartments for holding at least a pair of substances to be dispensed into a drinking glass or drinking cup. The end portions of the compartments are capped to hold the substances to be dispensed in place. In one embodiment the caps are located at opposite ends of the stirrer body portions so that the substances to be dispensed may be separately dispensed into the cup or glass. In another embodiment the caps are located at the same end of the stirrer body portion so that both substances may be simultaneously dispensed into the cup or glass. After one or both substances are dispensed into the cup or glass the stirrer body portion may be used to stir the dispensed item into the liquid in a mixing operation.

IV THE DRAWINGS

FIG. 2D is a detail view of a portion of FIG. 2B.

V DESCRIPTION OF PREFERRED EMBODIMENTS

Figure 1:
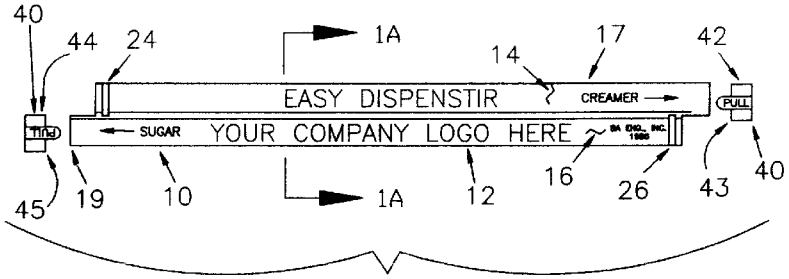
FIG. 1 is an exploded view of one embodiment of the present invention in which caps are provided at opposite ends of the combination stirrer and condiment dispenser so that the user may dispense only one or both the substances within the dispenser.
Figure 1A:
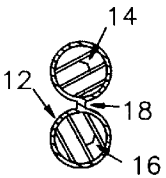
FIG. 1A is a sectional view looking in the direction of the arrows along the line 1A—1A in FIG. 1.

One embodiment of the present invention is illustrated in FIGS. 1, 1A, 2–2F, in which the combination stirrer and condiment dispenser 10 includes a hollow tube 12 made of inexpensive, non-toxic plastic material such as polypropylene and defining a pair of laterally spaced condiment holding chambers 14 and 16. In one embodiment as shown in FIG. 1(A) the body portion 12 may be extruded to define the chambers 14 and 16. A mid portion 18 maintains separation between the chambers 14 and 16.

It will be apparent that in this embodiment the portion 14 extends beyond the portion 16 at a first end 17 and the portion 16 extends beyond the portion 14 at a second end 19.

The body 12' is an extrusion, which is manufactured with an extrusion machine. An extrusion is created with an extrusion die, which is continuously fed molten material from a hopper. The material is forced through the die, which is similar in shape to the actual extrusion. The extrusion is cooled as it protrudes from the die, which gives it the desired shape. The extrusion is manufactured in length which creates the two chambers 14' and 16'.

The plastic material is extruded through an extrusion die to achieve the spaced compartments 14 and 16. An extrusion die is the preferred method of forming the compartments 14 and 16. Other methods known to those skilled in the art may be used.

Substances to be dispensed are then inserted into the respective ends 17 and 19 of the compartments 14 and 16. For example, sugar in it's crystalized state is inserted into the compartment 14. Similarly a non-dairy creamer, in powdered form, is then conveniently located within chamber portion 16.

The body 12' is to be heat sealed 73' at ends 24' and 26' at location 27'. The heat sealing operation is performed by heating two sixteenth of an inch probes, one on each side to a temperature slightly above the materials plastic deformation state. The purpose of the heat seal is to bond the two surfaces together while maintaining the materials structure and properties. The heat sealing process is demonstrated in FIGS. 3, 4 and 4A. The machine that will be used is demonstrated in FIGS. 5A, and 5B.

Prior to inserting the respective substances, the ends of the respective compartments 14 and 16 are crimped as indicated at 24 and 26 to hold the substances to be dispensed in place at the opposite end.

The particulate formations of substances to be dispensed are commercially available and do not form a part of the present invention.

After the respective particulate formations of substances to be dispensed 20 and 23 are inserted into the respective compartments 14 and 16 of the stirrer body portion 12, the respective ends of the compartments are provided with caps indicated generally at 40. The cap means may comprise caps 42 and 44 respectively, made of paper or the same plastic material as the body portion 12 and provided with a suitable adhesive 43, 45 to hold the cap in place on the body portion 12.

The top cap is perforated 56' at location, 47', and 48'. Once the product is contained in compartments 16' and 14', it can be dispersed by pulling tabs 47' and 48' along the perforated lines.

Figure 2E:
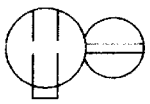
FIG. 2E is detail view looking in the direction of the arrows along the line 2E—2E in FIG. 2D.
Figure 2F:
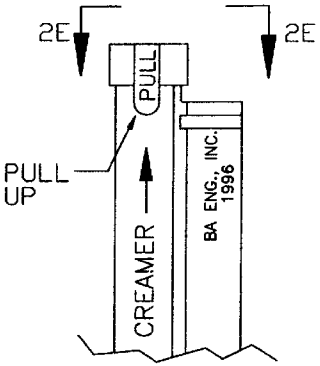
FIG. 2F is a plan view of the top assembly of the complete product with graphics.
Figure 2C:
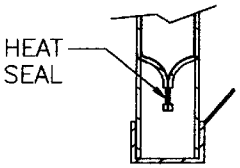
FIG. 2C is a detail view of a portion of FIG. 2.
Figure 2B:
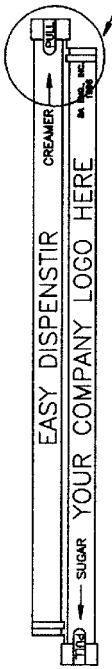
FIG. 2B is a top assembly of the complete product with graphics.
Figure 2A:
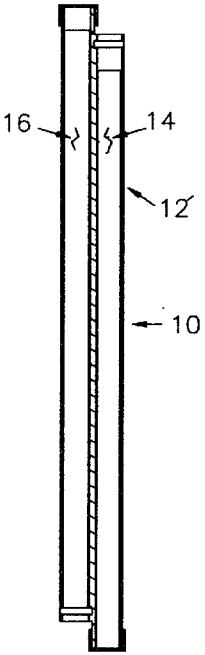
FIG. 2A is a sectional view of the assembled combination stirrer and condiment dispenser shown in FIG. 1.
Figure 2:
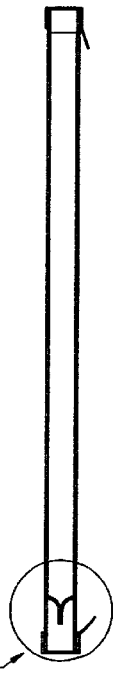
FIG. 2 is a plan view of the assembled combination stirrer and condiment dispenser shown in FIG. 1.

FIGS. 2 and 2A show the assembled combination stirrer and condiment dispenser with the substances 20 and 23 in place within the compartments 14 and 16 of the body portion 12. FIGS. 2B and 2F show the top assembly of the product illustrating sample graphics.

FIG. 2D illustrates a crimped end 26, and FIGS. 2D and 2E illustrate an end 17 with a cap 48 and a pull tab 50 to be used at either end of the device.

Figures 3, 3A, 4, 4A, 4B, 4C, 4D, 4E, 4F, 4G, 4H, 4J, 4K, 4L, 4M, 4N:
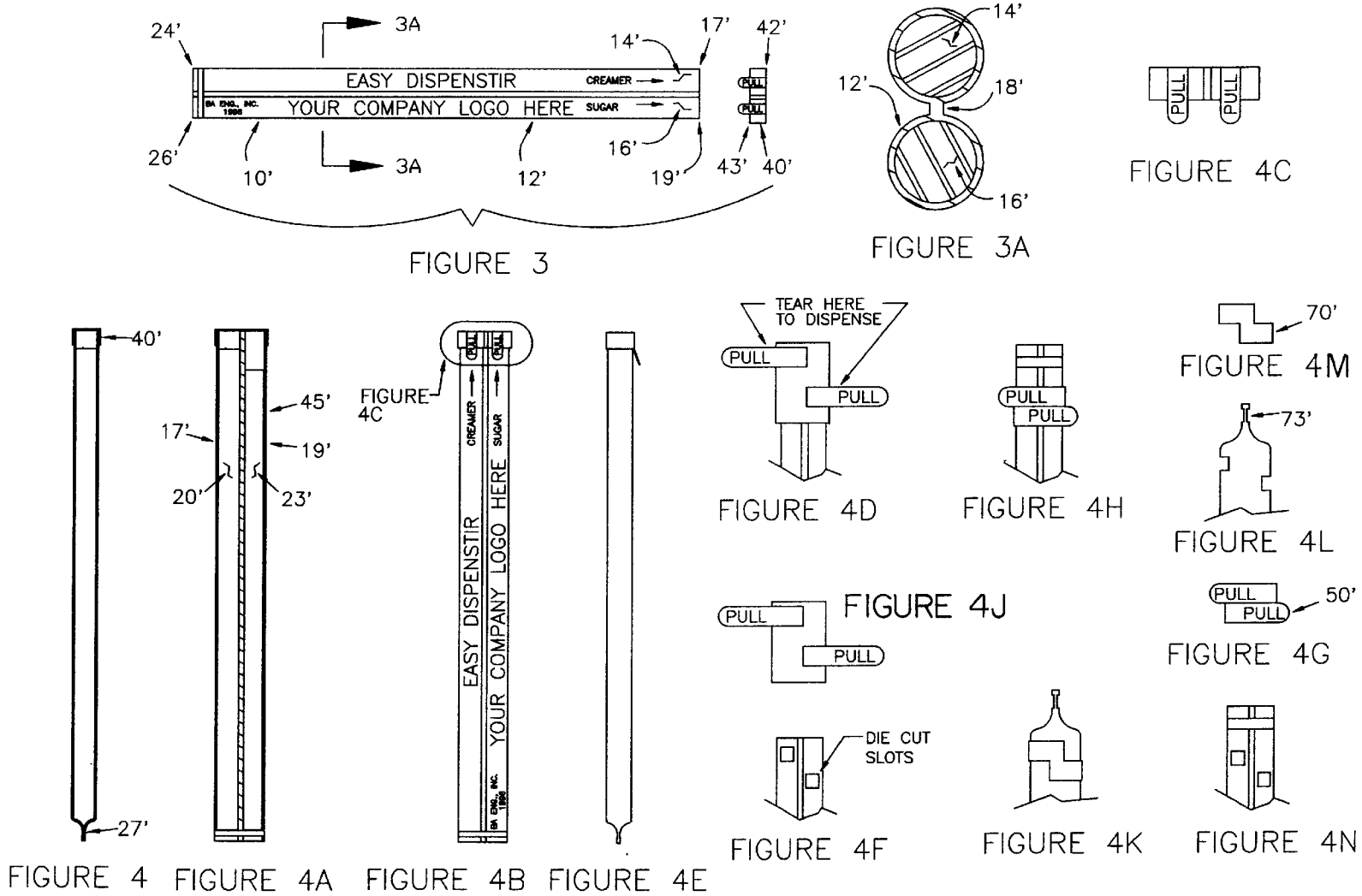
FIG. 3 is an exploded view of another embodiment of the present invention in which the caps are provided at one end only whereby the substances in the combination stirrer and condiment dispenser may be dispensed from the same end.
FIG. 3A is a sectional view looking in the direction of the arrows along the line 3A—3A in FIG. 3.
FIG. 4 is a plan view of the assembled combination stirrer and condiment dispenser shown in FIG. 3.
FIG. 4A is a sectional view of the assembled combination stirrer and condiment dispenser shown in FIG. 3.
FIG. 4B is a top assembly of the complete product with graphics.
FIG. 4E is a plan view of the top assembly of the product with graphics.
FIG. 4C is a detail view of a portion of FIG. 4B.
FIG. 4D is an exploded view of a first alternative cap design of the embodiment shown in FIGS. 3 and 4.
FIG. 4H is an exploded view of a second alternative cap design of the embodiment shown in FIGS. 3 and 4.
FIG. 4K is a plan view of the secondary cap design assembly.
FIG. 4F is a detail view of the dispenser body 12' modifications required for alternate design number 1.
FIG. 4N is a detail view of the dispenser body 12' modifications required for alternate design number 2.
FIG. 4L is a plan view of FIG. 4N.
FIG. 4G is a detail view of the top cap 50' for the first alternate cap design.
FIG. 4J is a detail view of the top cap 70' for the second alternate cap design.
FIG. 4M is a plan view of the top cap 70' for the second alternate cap design.

Another embodiment of present invention is shown in FIGS. 3, 3A, and 4–4N. In this embodiment the combination stirrer and condiment dispenser 10' includes a body portion 12' which is conveniently formed by means of an extrusion as indicated in FIG. 3A to define compartments 14' and 16', separated by a wall portion 18'.

In this embodiment the ends of the compartments 14' and 16' are both crimped at 27' at the same end as indicated at 24' and 26'. Thus the ends 17' and 19' are located at the same end of the assembly and are adopted to receive the substances to be dispensed 20' and 23' from the same ends 17' and 19'. Again the substances to be dispensed are provided in particulate form. For example, formed sugar, and non-dairy creamer may be used.

The substances to be dispensed are inserted in particulate form as indicated at 20' and 23' into the respective ends 17' and 19' of the chambers 14' and 16'.

After they are inserted, a cap means 40' is provided which covers both ends 17' and 19', and is held with a suitable adhesive 43' to secure the cap in place.

The cap means 40' is illustrated in FIGS. 3 and 4C and includes caps 42', and 43', which separately cover conduit portions 14', and 16', respectively. Each of the caps includes a tab 47', 48', to separately remove respective caps 42', and 43', when the condiments are to be dispensed through the openings 17', 19'. The liquid to be stirred may cause the particulate material 20', 23' to melt and/or dissolve.

It will be apparent that the embodiment in FIGS. 1 and 3 has the advantage that if desired the user need only remove one of the substances, such as sugar 20, and leave the non-dairy creamer 23 in place within the body portion and the body portion can still be used as a stirrer.

The embodiment shown in FIGS. 3 and 4 is most adopted to a situation wherein the user desires to use both the items to be dispensed, for example, sugar 20' and non-dairy creamer 23' and these may be dispensed from the same ends 17', 19'.

An alternate design is illustrated in FIGS. 4D, 4F, and 4G. The body of the extrusion 12', is die cut 53' at locations 54' and 55'. The operation is a simultaneous stamping which cuts the body in the desired locations The body 12' is heat sealed 73' at ends 24' and 26' sealing location 27', as indicated in FIGS. 4, and 4A. The heat sealing operation is performed by heating two sixteenth of an inch probes, one on each side to a temperature slightly above the materials plastic deformation state. The purpose of the heat seal is to bond the two surfaces together while maintaining the materials structure and properties.

The top cap 50' has two purpose's the first is to act as a cover, and the second is to dispense the contents. The material for the top cap will depend on the stirrers contents. The material for the top cap will either be paper, a vinyl blend or other compatible material. The chosen material is sufficiently strong enough to hold the contents, while keeping them in a consumable state.

The material used for the top cover is die cut at the outer edges 48', in sheet form to the required shape, as illustrated in FIG. 4C. The method of manufacturing is similar to a die operation, which fabricates the parts in a single sheet horizontally, top to bottom. After the top cap 50' is cut it is formed to the shape shown in FIG. 4D. The top cap 50' is then placed over the body 12' and adhesive bonded 79' at location 57'. The adhesive is one that is capable of sufficiently bonding the top cap material, to the extruded body, such as an Epoxy or other compatible material.

The top cap is perforated 56' at location 59', 60', 61' and 62'. Once the product is contained in compartments 16' and 14', it can be dispersed by pulling tabs 51' and 52' along the perforated lines. Once the tabs 51' and 52' are pulled the product can be dispensed freely.

The top cap material is paper, vinyl or a compatible material. The material is for the body 12' is plastic preferable polypropylene or other compatible material. The material is rigid enough to sufficiently withstand fracture if hit both longitudinally and latitudinally. The material also has the ability to withstand and react accordingly to the required operations that will be performed, including Die Cutting 53', and Adhesive Bonding 79'.

Another alternate design is illustrated in FIG. 3, 3A, 4H, 4J—4N. The body of the extrusion 12', is die cut 53' at locations 74' and 75'. The operation is a simultaneous stamping with a die punch, which will cut the body in the desired location.

The body 12' is heat sealed 73' at ends 24', and 26', at location 27'. The heat sealing operation is performed by heating two sixteenth of an inch probes, one on each side to a temperature slightly above the materials plastic deformation state. The purpose of the heat seal is to bond the two surfaces together while maintaining the materials structure and properties.

The product 20' and 23' is inserted at ends 17' and 19' into compartments 16' and 14'. Once the products 20' and 23' are inserted, the body 12' is heat sealed 73' at ends 17', and 19', at location 27'.

The top cap 70' has two purpose's. The first is to act as a cover, and the second is to dispense the contents. The material for the top cap will depend on the stirrers contents. The material for the top cap may be paper, a vinyl blend or a compatible material. The chosen material will have to be sufficiently strong enough to hold the contents, while keeping the contents in a consumable state.

The top cap material may be paper, vinyl or a compatible material. The material for the body is plastic preferably polypropylene or another compatible material. The material should be sufficiently rigid enough to withstand fracture if hit both horizontally and vertically. The material should also have the strength to withstand and react accordingly to the required operations that will be performed to, such as Die Cutting 53', Heat Sealing 73', and Adhesive Bonding 79'.

The material used for the top cover is die cut at the outer edges 70', in sheet form to the required shape. The method of manufacturing will be similar to a die operation, which fabricates the parts in a single sheet horizontally, top to bottom. After the top cap 70' is cut it is formed to the shape shown in FIG. 4J. The top cap 70' is then placed over the body 12' and adhesive bonded 79' at location 77'. The adhesive used is sufficiently strong enough to bond the top cap material, to the extruded body, such as an epoxy blend or other compatible material.

The top cap is perforated 76' at location 78'. Once the product is contained in compartments 16' and 14', it can be dispersed by pulling tabs 71' and 72' along the perforated lines. Once the tabs 71' and 72' are pulled the product can be dispensed freely.

Figure 5A:
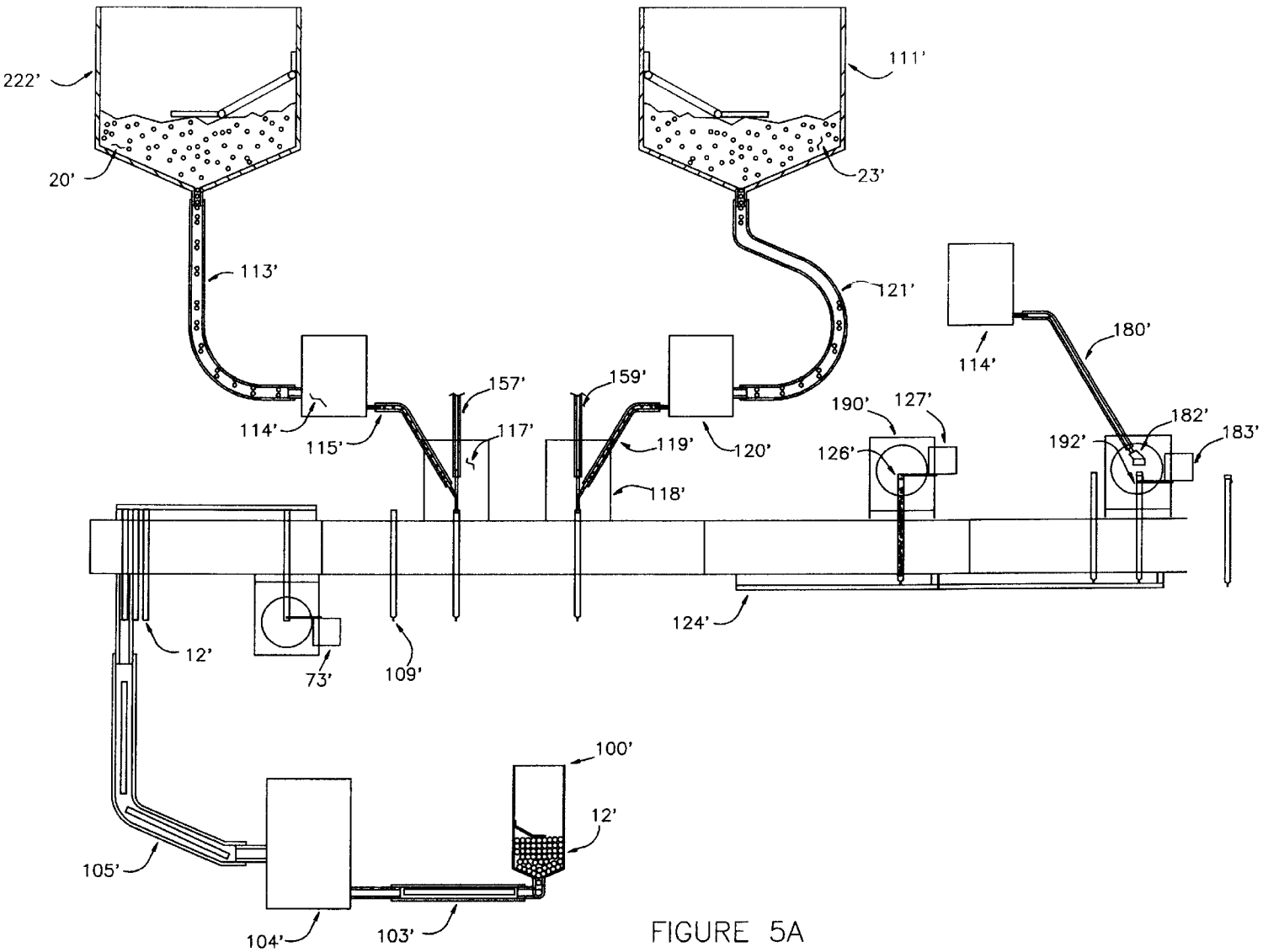
FIG. 5A is a schematic side elevation view of a first embodiment of an automated assembly machine to assemble the combination stirrer and condiment dispenser of the present invention.
Figure 5B:
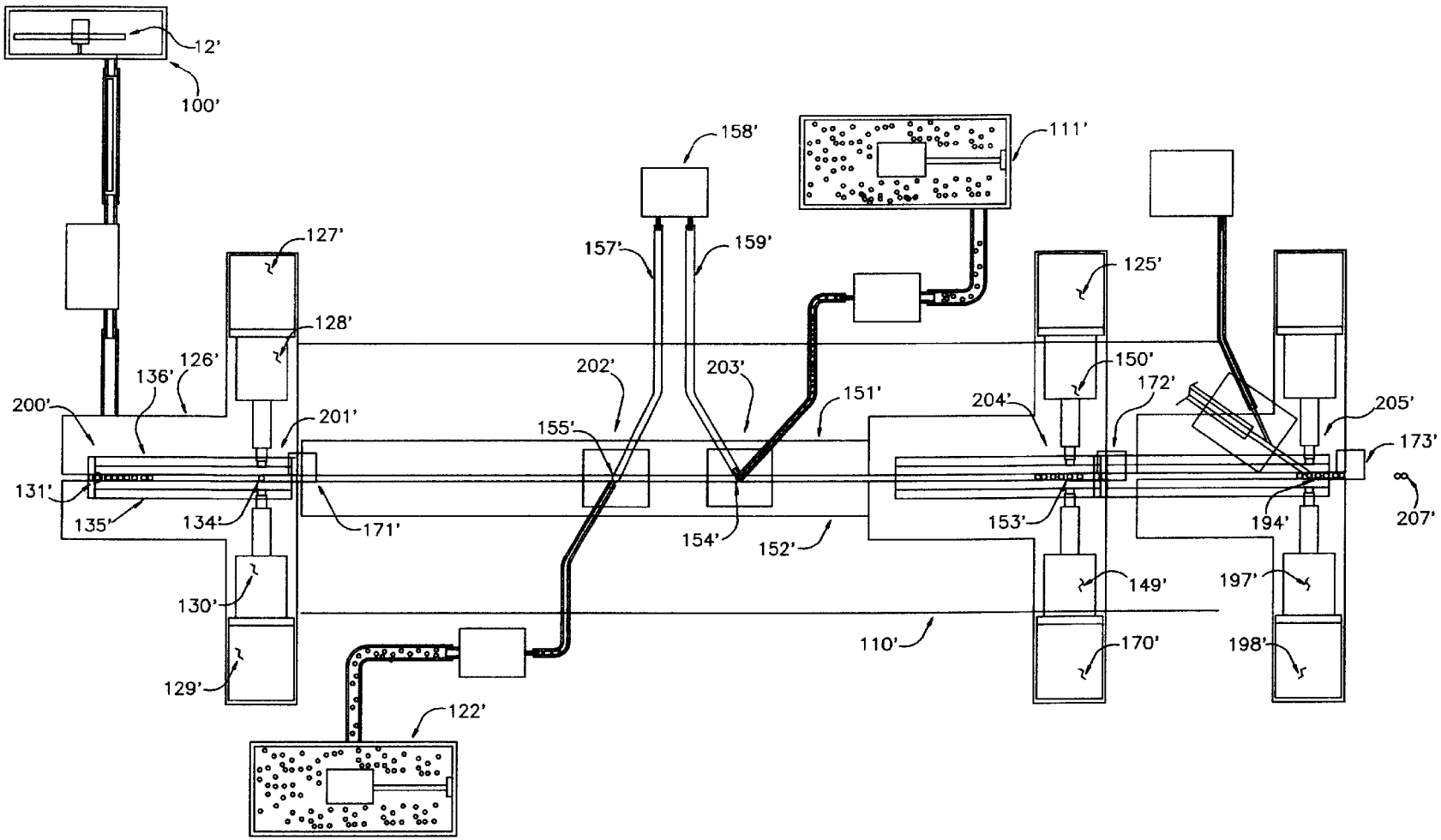
FIG. 5B is a side view of a first embodiment of an automated assembly machine to assemble the combination stirrer and condiment dispenser of the present invention.

FIGS. 5A, and 5B illustrate a completely automated assembly machine which mass produces the product from the initial stage 12' to a final product 207'. There are seven stations to this machine.

The first station 200' is a feeding station. The raw extrusion's are stored in a hopper 100' which distributes the extrusions 12' through a conduit 103' one at a time to a known pressurized system 104'. The pressurized system 104' feeds the extrusions 12' through a hose 105'. The extrusion 12' is forced upward where it hits the top plates 135' and 136', which act as guides that direct the extrusion to the stop block 171'. Once the extrusion reaches the top plates 135' and 136' it is guided between them throughout the machine.

The second station 201' is a heat crimping operation. The extrusion 12' is fed to location 201', where it is compressed by two pistons 128' and 130' acting in cylinders 127', 129' that are fitted with heat tips 128', 130'. The crimped extrusion is then fed to station three.

The third station 202' is responsible for loading the product 20' into the extrusion 12'. The product (Sugar 20') is fed from the hopper 122', through hose 113', to the distribution system 114'. The distribution system 114', distributes predetermined amounts of product through the hose 115'. Hose 157' is pressurized, and in chamber 117' forces the product into chamber 14' of the extrusion 12'. The extrusion is then fed to location 203'.

The fourth station 203' is responsible for loading the product 23' into the extrusion 12'. The product (Non-Dairy Creamer 23') is fed from the hopper 111', through hose 121', to the distribution system 120'. The distribution system 120', distributes predetermined amounts of product through the hose 119'. Hose 159' is pressurized, and in chamber 119' forces the product into chamber 16' of the extrusion 12'. The extrusion is then fed to location 204'.

The fifth station 204' is an adhesive application operation. The extrusion 12' is fed to location 204' where it is stopped by the stop block 172'. The two pistons 149', 150' acting in cylinders 150', 170' which are fitted with pads that contain an adhesive, extend and apply adhesive to the extrusion body. The extrusions are then fed station six.

The sixth station 205' is an assembly operation. The extrusion 12' is fed to location 205', where it is stopped by a stropping block 173'. A distributing system 194' is used to feed the top cap 40', through hose 180', where it is located in the fitting tip 182'. The fitting tip 182' applies the top cap 40' to the extrusion. This is the final station, which produces a finished product 207'.

What is claimed is:

1. A combination stirrer and condiment dispenser comprising:

a longitudinally extending body portion defining at least a pair of laterally spaced condiment compartments and an external wall; said condiment compartments being separated by a transversely extending wall portion integral with said body portion;

at least one condiment to be dispensed located within at least one of said compartments;

removable cap means located at least one end of said body portion to removable hold in place said condiment and, at an opposite end of said body portion means for permanently maintaining said condiment within said compartment; said body portion being generally elongated and sufficiently small in cross section to be placed within cups and glasses with sufficient clearance to allow stirring of beverages located within said cups and glasses; and said body portion being made entirely of non-dissolving material whereby said external wall will not dissolve in liquid contained within said cups and glasses, and whereby the entire length of said external wall located within said cups and glasses may be used for stirring of beverages located within said cups and glasses.

2. A combination stirrer and condiment dispenser according to claim 1 wherein said compartments each have an end portion permanently closed off and wherein said end portions are at opposite ends of said body portion.

3. A combination stirrer and condiment dispenser according to claim 2 wherein each of said compartments contain cap means and wherein said cap means are located at opposite ends of said body portion.

4. A combination stirrer and condiment dispenser according to claim 1 wherein each of said compartments includes a first end portion which is permanently closed off and wherein each of said compartments have a second, opposite end portion having cap means to removable hold in place at least one condiment.

5. A combination stirrer and condiment dispenser according to claim 4 wherein separate cap means are provided for each of said condiment compartments.

6. A combination stirrer and condiment dispenser according to claim 1 wherein said compartments are separated by an wall portion.

7. A combination stirrer and condiment dispenser according to claim 1 wherein said body portion is made of plastic.

8. A combination stirrer and condiment dispenser according to claim 1 wherein said condiments are provided in particulate form.

9. A combination stirrer and condiment dispenser according to claim 8 wherein one of said condiments comprises sugar in particulate form.

10. A combination of stirrer and condiment dispenser according to claim 9 wherein another of said condiments comprises non-dairy creamer in particulate form.

* * * * *